US008096732B2

(12) United States Patent
Brown

(10) Patent No.: US 8,096,732 B2
(45) **Date of Patent: *Jan. 17, 2012**

(54) METHODS AND APPARATUS FOR FOUNDATION SYSTEM

(75) Inventor: Robert K. Brown, Phoenix, AZ (US)

(73) Assignee: Arizona Ramjack, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/031,364

(22) Filed: Feb. 21, 2011

(65) Prior Publication Data

US 2011/0138736 A1 Jun. 16, 2011

Related U.S. Application Data

(63) Continuation of application No. 11/749,724, filed on May 16, 2007, now Pat. No. 7,914,235.

(60) Provisional application No. 60/747,407, filed on May 16, 2006.

(51) Int. Cl.
*E02D 7/00* (2006.01)

(52) U.S. Cl. ..... 405/229; 405/231; 405/232; 405/244

(58) Field of Classification Search ..... 405/229, 405/230, 231, 232, 244; 52/169.4, 169.6, 52/741.11

See application file for complete search history.

(56) References Cited

U.S. PATENT DOCUMENTS

| | | | | |
|---|---|---|---|---|
| 4,612,748 | A * | 9/1986 | Arnold et al. | 52/309.16 |
| 5,678,378 | A * | 10/1997 | Ellison, Jr. | 52/692 |
| 5,771,655 | A * | 6/1998 | Strickland et al. | 52/745.2 |
| 6,058,662 | A * | 5/2000 | Perko | 52/157 |
| 2006/0042874 | A1 * | 3/2006 | Foster et al. | 181/285 |

* cited by examiner

*Primary Examiner* — David Bagnell
*Assistant Examiner* — Benjamin Fiorello
(74) *Attorney, Agent, or Firm* — The Noblitt Group, PLLC

(57) ABSTRACT

Methods and apparatus for foundation systems generally include a vertical support. a horizontal support configured to couple to the vertical support, and a composite material configured to couple to the horizontal support. The vertical support may be configured to resist fluctuation in soil elevation. The composite material may comprise a block material and a fibrous material.

14 Claims, 3 Drawing Sheets

METHODS AND APPARATUS FOR FOUNDATION SYSTEM

CROSS-REFERENCES TO RELATED APPLICATIONS

This application is a continuation of U.S. patent application Ser. No. 11/749,724, filed on May 16, 2007, which claims the benefit of U.S. Provisional Patent Application No. 60/747,407 filed 16 May 2006, and incorporates the disclosure of each application in its entirety by reference. To the extent that the present disclosure conflicts with any referenced application, however, the present disclosure is to be given priority.

BACKGROUND OF INVENTION

Portions of the ground exhibit fluid characteristics. As a consequence, it is generally necessary to provide a solid surface, such as a foundation, before construction of a building. While a foundation may provide a more stable substructure than bare ground, the fluid properties of the ground may reduce the utility of the foundation. Fluctuations in soil conditions, such as heaving and settling, may cause the foundation to be disturbed from its original orientation. Fluctuations may also cause structural stresses within and damage to the foundation. These defects may be transferred to the superstructure, reducing the utility of the entire building.

SUMMARY OF THE INVENTION

In various representative aspects, methods and apparatus according to various aspects of the present invention operate in conjunction with a vertical support, a horizontal support configured to couple to the vertical support, and a composite material configured to couple to the horizontal support. The vertical support may be configured to resist fluctuation in soil elevation. The composite material may comprise a block material and a fibrous material.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of components configured to perform the specified operations and achieve the various results. For example, the present invention may employ various machines, techniques, and processes, e.g., cement mixers, jackhammers, shovels, pneumatic drills, foundation anchoring equipment, and/or the like. Such techniques, processes, and/or the like may be implemented to repair and/or install various materials and systems, e.g., helical piers, bar joists, cement, grout, rebar, carbon fiber, and/or the like. In addition, the present invention may be practiced in conjunction with any number of superstructure designs and foundation systems, and the system described herein is merely one exemplary application for the invention. Further, the present invention may employ any number of conventional techniques for fabrication, installation, soil analysis, construction, and/or the like.

Figure 1:
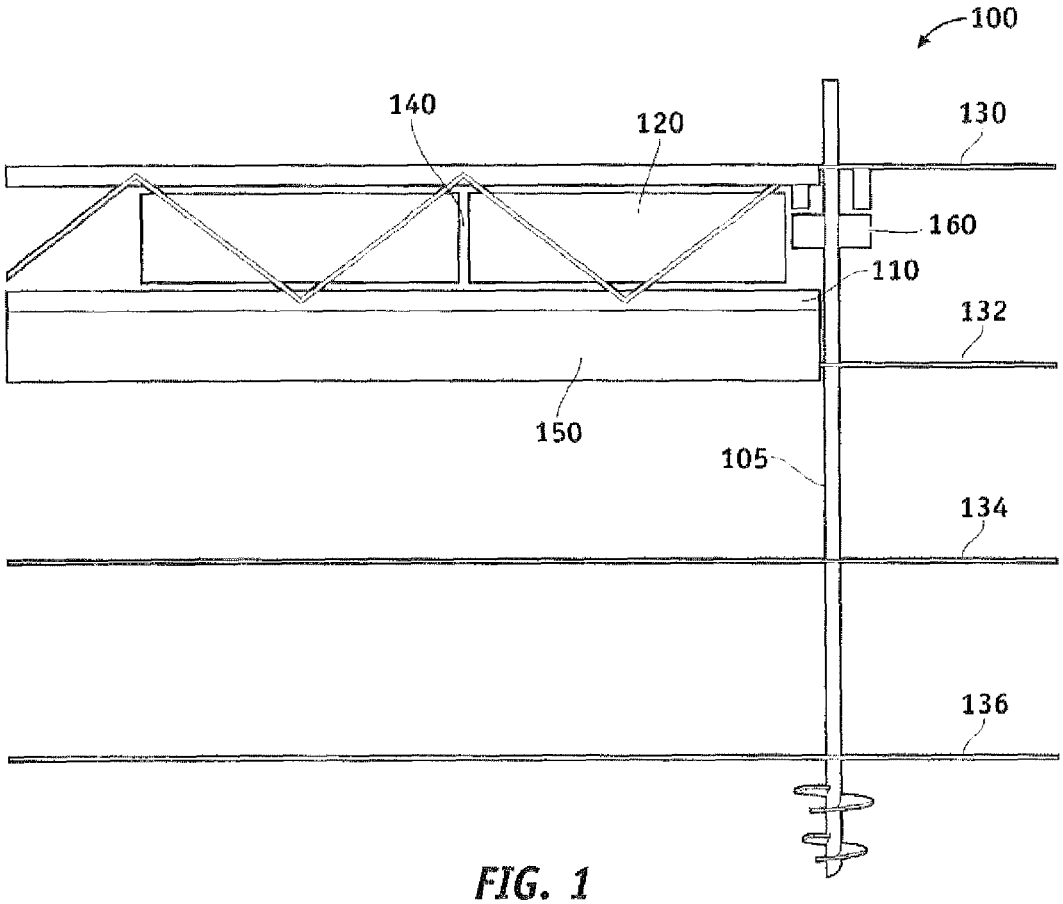
FIG. 1 representatively illustrates a side view of an implemented foundation system.

Various representative implementations of the present invention may be applied to any system for installation, repair, and/or modification of a foundation. Certain representative implementations may include, for example, a foundation for a residential building, a foundation for a commercial structure, a vehicle path such as a road, or an industrial structure such as an electrical substation. Referring now to FIG. 1, a foundation system 100 according to various aspects of the present invention may isolate a surface from the effects of soil fluctuations. The foundation system 100 may comprise any system for reducing the influence of expanding and/or contracting soils and operate in conjunction with any appropriate structure, such as rebar, concrete structures, and/or the like. For example, the foundation system 100 may be configured to support movement of mass, such as people and/or vehicles.

The foundation system 100 may be configured to connect with and/or isolate other systems such as substructure, superstructure, utilities, and/or the like as well as other foundation systems including cement slabs, pillars, crawlspaces, and/or the like. In the present embodiment, the foundation system 100 comprises one or more vertical supports 105 secured within the ground. The vertical supports 105 may be coupled to one or more horizontal supports 160, which may be coupled to a plurality of spanning supports 110. The spanning supports 110 may engage and/or support one or more composite blocks 120, which may be coupled together using a filler material 140 such as grout, wire, and/or the like. Further, the spanning supports 110 may be separated from the ground via a void. Within this void, the foundation system 100 may include a buffer 150.

The vertical support 105 may be resist fluctuation in soil elevation. The vertical support 105 may comprise any system to be affixed within a subsurface layer 132. For example, a given soil may comprise multiple layers 130, 132, 134, 136 distinguishable by their tendency to fluctuate. In layers near the surface 130, the soil may be susceptible to swelling, shrinking, liquefaction, and/or the like according to temperature, humidity, flora, fauna, and/or the like. At greater depths 132, 134, 136, the soil conditions may be more stable, for example due to relative impermeability of the soil, the weight of soil at a specified depth 132, 134, 136, or other factors. Accordingly, the vertical support 105 may anchored at a depth corresponding to relatively stable soil conditions.

In the present embodiment, the vertical support 105 comprises a helical pier configured to secure within the ground at a selected depth 132. At the selected depth 132, the soil conditions are such that the vertical support 105 is substantially resistant to fluctuations in the surface soil 130. The selected depth 132 may vary depending on the local soil conditions. For example, some soils, like sandy and silty soils, may be highly variable at a significant depth 134 such that the vertical support 105 may be impervious to soil fluctuations by coupling of the vertical support at a relatively deep selected depth 136. By contrast, some soils like rocky soils may be resistant to fluctuations in soil elevation and accordingly the vertical support 105 may be suited to coupling at a relatively shallow depth 134.

The vertical support 105 may be secured within the soil. For example, the vertical support 105 may comprise a conventional helical pier, such as a support including an annularly inclined plane such that the vertical support 105 is substantially immobilized after it has been installed within the soil. As another example, the vertical support 105 may include one or more flanges configured to substantially immobilize the vertical support 105 after it has been installed within the soil. The vertical support 105 may comprise a preformed structure, such as a helical pier or wooden post, or may be formed on-site, as with a poured concrete and rebar combination.

Combinations of structures may be implemented to secure the vertical support 105. For example, the vertical support 105 may comprise a helical pier that is driven into concrete prior to curing of the concrete. As another example, the vertical support 105 may comprise a helical pier configured to rest upon a concrete footing. The vertical support 105 may be configured to substantially permanently couple within the soil, as in the case of a residential home, or temporarily, as in the case of a seasonal pier. Factors such as cost, local soil conditions, engineering requirements for the vertical support 105, and/or the like may influence the design.

Figure 3:
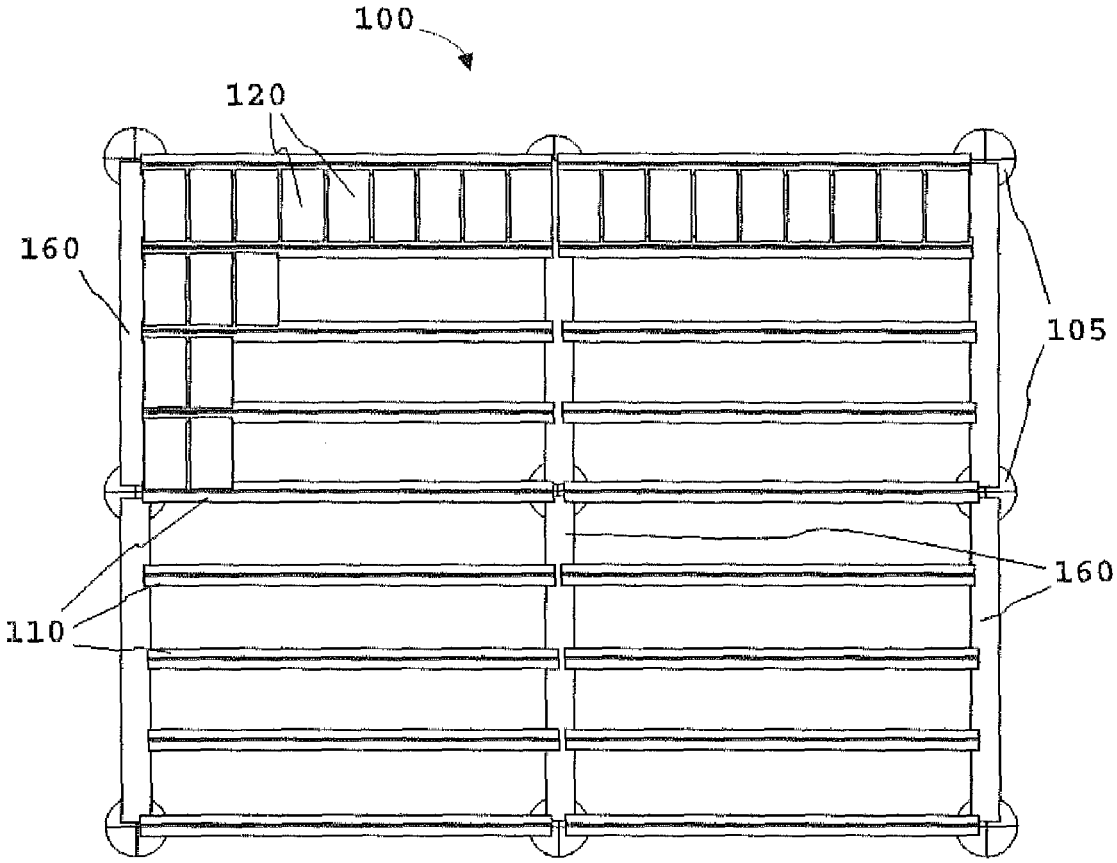
FIG. 3 representatively illustrates a plan view of an implemented foundation system with the upper flange of a spanning support removed.

Referring now to FIGS. 1 and 3, the horizontal support 160 may provide a substantially horizontal structure. The horizontal support 160 may comprise any system for transitioning from a structure substantially unsuited to construction of a flat surface, such as the vertical support 105, to a structure substantially suited to construction of a flat surface. In one embodiment, each horizontal support 160 comprises a beam member such as an I-beam that is suitably configured to coupled to one or more vertical supports 105. By virtue of the secure coupling between the vertical support 105 and the ground and between the vertical support 105 and the horizontal support 160, the horizontal support 160 may be rendered substantially stable relative to fluctuations in the soil. In an alternative embodiment, the horizontal support 160 may comprise any appropriate horizontal structure, such as a metallic bar joist, a wooden beam, or a rebar support.

The horizontal support 160 may be configured to couple to various structures. For example, the vertical support 105 and the horizontal support 160 may comprise corresponding surface geometries with which the vertical support 105 may couple to the horizontal support via the insertion of fasteners such as bolts, the fusion of the surface as by welding, and/or the like. As another example, the horizontal support 160 may be configured to couple to a single vertical support 105, such as in a "T" configuration. Alternatively, multiple vertical supports 105 may be configured to couple to a single horizontal support 160, such as in an "H" configuration. Further, multiple horizontal supports 160 may be configured to couple to a single vertical support 105, as in a jackstone configuration.

Figure 2:
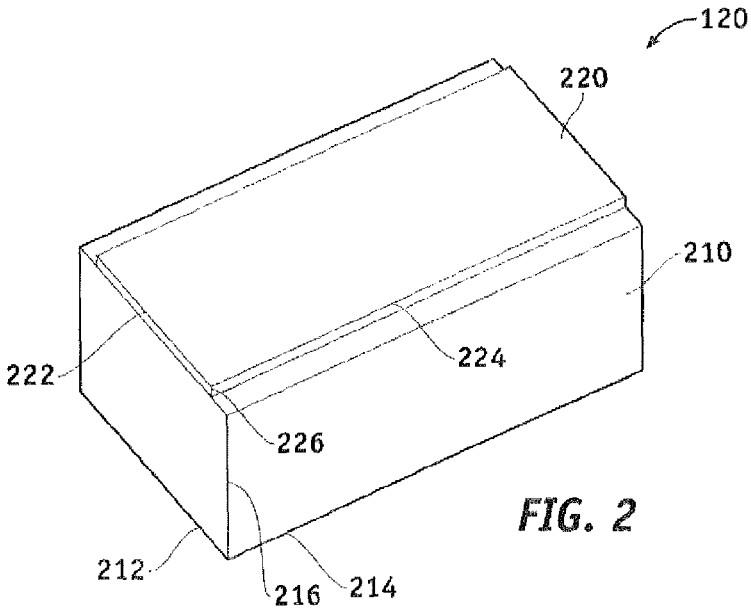
FIG. 2 representatively illustrates an orthographic view of a composite block.

The composite block 120 provides a surface supported by at least one of the spanning, supports 110 and/or the horizontal supports 160. The composite block 120 may comprise any system for transferring force across a substantially planar geometry. Referring now to FIG. 2, in the present embodiment, the composite block 120 comprises one or more pieces of block material 210 coupled with one or more pieces of fibrous material 220. The composite block 120 may, however, comprise any appropriate material or configuration.

Referring again to FIG. 3, in the present embodiment, the composite block 120 is supported by one or more spanning supports 110 and/or one or more horizontal supports 160. For example, each of a pair of parallel spanning supports 110 may comprise a bar joist configured with an upper and lower flange, wherein the lower flange receives one or more composite blocks 120 such that the interface between the one or more composite blocks 120 and the pair of spanning supports 110 is substantially free of gaps. As another example, the spanning support 110 and the composite block 120 may comprise corresponding surface geometries, such as notches on the surface of the spanning support 110 and corresponding grooves in the composite block 120. As yet another example, connecting structures such as wire mesh, grout, epoxy, and/or the like may be applied to couple one or more composite blocks 120 together and/or to a support structure, such as the spanning supports 110, horizontal supports 160, and/or the vertical support 105.

The block material 210 provides volume and/or a support surface. The block material 210 may comprise any material and/or element for transferring force, such as a substantially homogeneous material, reinforced concrete, and/or the like. In the present embodiment, the block material 210 comprises aerated autoclaved concrete having dimensions configured for the parameters of a specified foundation installation.

The block material 210 may be adapted according to a particular application and/or environment. For example, the block material 210 may exhibit a specified material property, for example, within the composite block 120. The block material 210 may have selected material properties, such as a specified density, compressive strength, yield strength, glass transition temperature, Poisson's ratio, tensile strength, thermal conductivity, emissivity, and/or the like. In one embodiment, the block material 210 may comprise an aerated autoclaved concrete having a density between 0.01 and 0.70 pounds per cubic inch (lbs/in$^3$) and a compressive strength of between 72 and 915 pounds of force per square inch (psi). Alternatively, the block material 210 may comprise a concrete having a density of between 0.043 and 0.105 lbs/in$^3$ and a compressive strength of less than 5100 MPa. The material properties of the block material 210 may be modified through modification of the constituent material elements, modification to the material formation process, and/or the like.

The block material 210 may comprise various dimensions and geometries. In one embodiment, the block material 210 comprises a six-sided polyhedron having a length 214 of about 10 feet, a height 216 of about 2 feet, and a width 212 of about 6 feet. In another embodiment, the block material 210 comprises a six-sided polyhedron having a length 214 of about 5 feet, a height 216 of about 2 feet, and a width 212 of about 6 feet. The block material 210 may comprise any appropriate dimensions and geometries such as an ellipsoidal geometry, a polygonal geometry, convexity, concavity, and/or the like.

The fibrous material 220 may be configured to withstand a specified stress condition. The fibrous material 220 may comprise any system for responding to changes in force. In the present embodiment, the fibrous material 220 comprises a piece of fiberglass configured to operate in conjunction with an aerated autoclaved concrete in a composite. The fibrous material 220 may, however, comprise any appropriate materials and dimensions.

The fibrous material 220 may couple to various structures in various embodiments. For example, the fibrous material 220 may be coupled to the block material 210 to form the composite block 120. The couple between the two may be via epoxy, adhesive, fasteners such as nails, screws, via formation of the block material 210 to include one or more pieces of fibrous material 220, and/or the like. In addition, a single piece of fibrous material 220 may be configured to couple to a single piece of block material 210, multiple pieces of fibrous material 220 may be configured to a single block material 210, a single piece of fibrous material 220 may be configured to couple to multiple pieces of block material 210, and/or the like.

The couple between the block material 210 and the fibrous material 220 may influence the material properties of the composite block 120. For example, if the block material 210 has a low density but is brittle, a durable fibrous material 220 may be coupled to the block material 210 to form the composite block 120 having a low resultant density and a substantially high resultant strength. As another example, the fibrous material 210 may have a first tensile strength in the longitudinal direction and a second tensile strength in the transverse direction. Accordingly, the resultant material properties may relate to the orientation of the fibrous material 210 with respect to the block material 210. The fibrous material 220 and the block material 210 may be configured to couple in various embodiments such as according to composite material theory, according to cost minimization, and/or the like.

The buffer 150 may be configured to absorb fluctuations in the soil. The buffer 150 may comprise any system for isolating structures above the buffer ISO, such as the horizontal support 110 and the composite block 120. In the present embodiment, the buffer 150 comprises a polymer foam configured to isolate each composite block 120 and horizontal support 110 from the ground. For example, the composite block 120 and the horizontal support 110 may be suspended above the surface of the ground 150 forming a void. The buffer 150 may be configured to at least partially fill this void, for example, to reduce heat transfer through the void, to prevent transfer of fluid via the void, and/or the like.

The buffer 150 may adapted to various applications and environments. For example, the buffer 150 may comprise a malleable material such as polyurethane foam to accommodate fluctuations in soil below the foundation system 100. As another example, the buffer 150 may comprise an herbicide to prevent growth of plant matter below the foundation system 100.

The filler material 140 may provide a smooth surface, bind elements together, and/or serve other purposes. The filler material 140 may comprise any system or material for reducing gaps and/or indentations, as such as those between the composite blocks 120, the horizontal supports 110, and/or the vertical supports 105. In the present embodiment, filler material 140 comprises a grout and/or wire layer disposed along the interfaces between and/or top surface of the composite block 120 and/or the horizontal support 115.

The filler material 140 may couple to other structures in any appropriate manner. For example, the filler material 140 may be configured to bind together two or more composite blocks 120, two or more horizontal supports 110, one or more composite blocks 120 with one or more horizontal supports, and/or the like via inherent adhesive characteristics of the filler material 140. As another example, the filler material 140 may be configured conform to the surface of a composite block 120 via hardening of the filler material 140 following a fluid pour.

Figure 4:
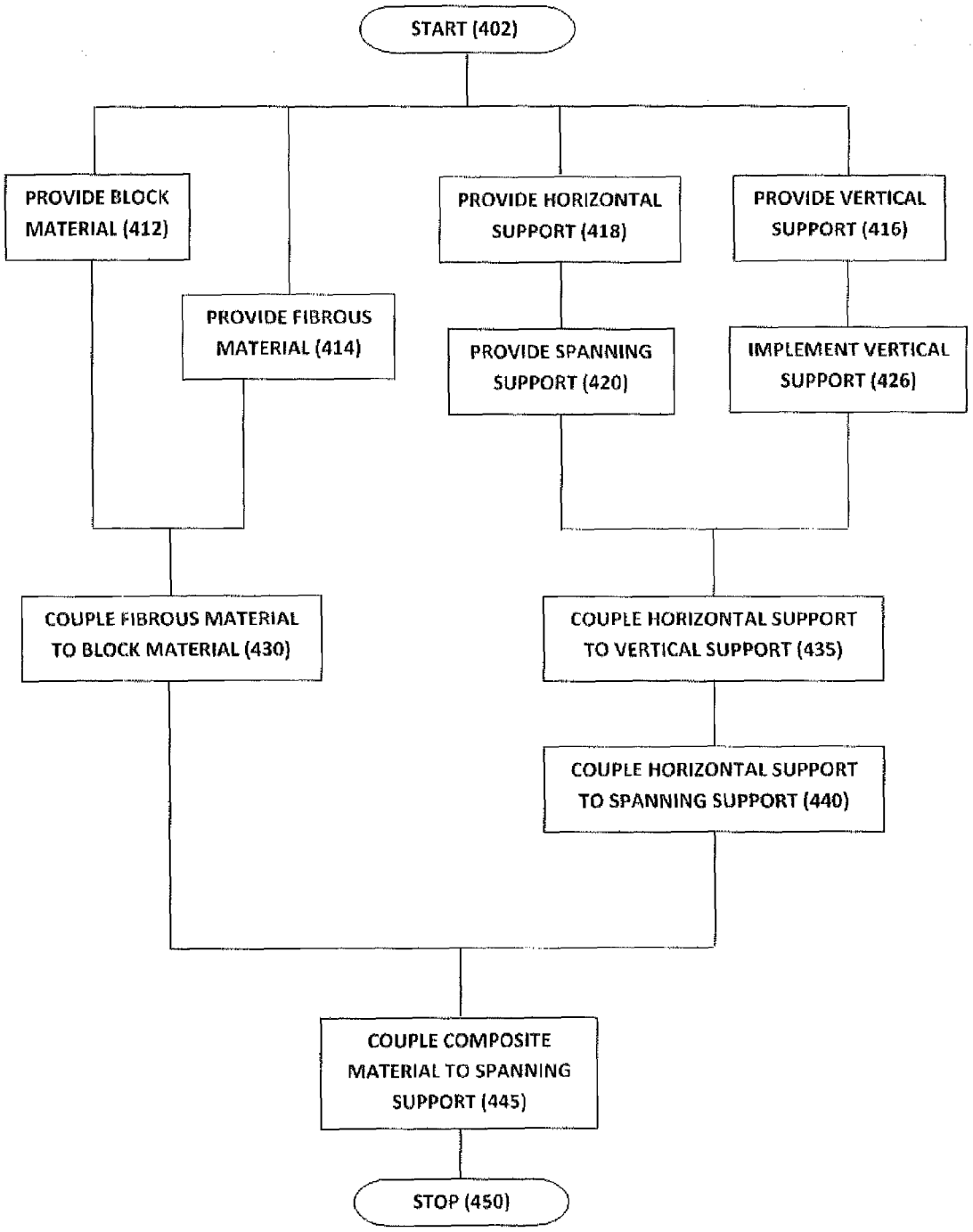
FIG. 4 representatively illustrates a flowchart of a method implementing a foundation system.

The foundation system 100 may be implemented using various methods and technologies. The implementation may be made in any appropriate manner such as identification of soil to be excavated, excavation of the soil, installation of one or more vertical supports 105, coupling of one or more horizontal supports 110 to the vertical supports 105, formation and implementation of one or more composite blocks 120, and/or the like. Referring now to FIG. 4, in one embodiment, vertical supports 105, spanning supports 110, and horizontal supports 160 are furnished at the job site (416, 418, 420). The vertical supports 105 are installed (426) and the horizontal supports 160 are coupled to the vertical supports 105 (435). The spanning supports 110 are then coupled to the horizontal supports 160 (440). The block material 210 and the fibrous material 220 are likewise furnished at the job site (412. 414). The block material 210 is coupled with the fibrous material 220 (430) and a finished composite block 120 is formed (430). The composite block 120 is coupled to the spanning supports 110 (445) and finishing operations, if any, are performed. The foundation system 100 may, however, be implemented in any appropriate manner.

The area comprising the foundation system 100 may vary with the specified application. For example, for new structures, the foundation system 100 may comprise the entire foundation or a portion of the foundation. As another example, for existing structures, the foundation system 100 may replace the entire existing foundation or replace a portion of the existing foundation. As yet another example, the foundation system 100 may replace various portions of an existing foundation and/or provide a foundation for additions to existing structures. Exemplary embodiments of the present invention may be implemented in any appropriate manner.

The soil below and/or around the foundation system 100 may be evaluated according to various methods and techniques. For example, the soil may be analyzed prior to construction. The analysis may apply to the present soil conditions, as in the case of substantially stable soils. However, this analysis may not apply to present soil conditions, as in the case of substantially fluctuating soils. Accordingly, equipment such as manometers, ultrasound equipment, subterranean imaging systems, and/or the like may be employed. For example, in the case of a manometer, the soil may be tested to determine areas of high and low pressure below the soil. In response to the test results, components such as the vertical supports 105 and/or the buffer 150 may be installed accordingly.

The vertical support 105, the spanning support 110, and/or the horizontal support 160 may be furnished (416, 418, 420) according to the intended structure and/or application for the vertical support 105. For example, if the soil conditions and/or intended use of the foundation system 100 are suited to a metal alloy bar, such a bar may be provided at the job site in a substantially formed embodiment. As another example, if the soil conditions and/or intended use of the foundation system are suited to a reinforced concrete, such concrete may be provided at the job site in the form of fluid concrete and rebar. Factors such as the materials comprising the vertical supports 105 and/or horizontal supports 110, the availability of formed structures in the vicinity of the job site, and/or the like may influence how the vertical support 105 and/or the horizontal support 110 is provided to a job site.

Vertical supports 105 may be installed (426) using various methods and/or techniques. The vertical support 105 may be installed according to its structure. For example, a helical pier may be installed via rotation of the helical pier according to an inclined plane portion of the helical pier. As another example, a post may be installed with an axial force as by a hammer. As yet another example, the vertical support 105 may be formed within the ground as in the case of a concrete and rebar pillar. The vertical support 105 may be installed such that it is secured within the soil at a depth 136 where the soil is substantially impervious to fluctuations in elevation.

Horizontal supports 160 may be coupled to the vertical support 105 (435) using various methods and/or techniques. For example, the horizontal support 160 may be fastened to the vertical support 105 as by a bolt hole in the horizontal support 160 and the vertical support 105. As another example, the vertical support 105 may be coupled with the horizontal support 160 via an intermediate structure such as a bracket. As yet another example, the vertical support 105 may be coupled with the horizontal support 160 by bonding, as by welding, the materials comprising the supports. Combinations of various techniques, such as bracketing to align structures, followed by welding, followed by de-bracketing, may be implemented in any appropriate manner.

Implementation of the vertical supports 105 (426) and coupling of horizontal supports 160 to the spanning supports 110 (440) may be performed in various embodiments. For example, a pair of the spanning supports 110 may be spaced to a specified dimension according to the geometry of the composite block 120. As another example, a composite block 120 may be formed according to the spacing of the spanning supports 110.

The block material 210 and the fibrous material 220 may be furnished (412, 414) using various methods and/or techniques. For example, the block material 210 and/or the fibrous material 220 may be a prefabricated structure formed at a factory and delivered to the job site. As another example, the block material 210 and/or the fibrous material 220 may be formed on-site as in the case of certain concretes and/or certain fibrous composites.

The block material 210 may be coupled with the fibrous material 220 (430) using various methods and/or techniques. For example, the fibrous material 220 and the block material 210 may be coupled together by applying adhesives, attaching one or more fasteners, and/or the like. As another example, the fibrous material 220 may be interspersed within the block material 210 during formation of the composite block 210 and held in place due to friction as between the fibrous material 210 and the block material 210.

A finished composite block 120 may be formed (430) using various methods and/or techniques. For example, the block material 210 may be included within the composite block 120 and configured for low-intensity finishing. Low-intensity finishing may describe the process of rapidly modifying on-site the dimensions of a solid block material 210 as by portable tools such as such as fine wire, circular saws, and/or jigsaws. Low-intensity finishing may be defined in contradistinction to the process of pouring, tending, and curing concrete, and/or molding of an otherwise fluid material. Many materials including varieties of aerated autoclaved concrete may be configured for low intensity finishing, such as bifurcation via a vibrating fine wire. The block material 210 configured for low-intensity finishing may be formed, for example, according to the dimensions of spanning supports 110 to which the composite block 120 is to couple. Such a material may include the fibrous material 220 or may be coupled to the fibrous material 220 after low-intensity finishing. As another example, the composite block 120 may comprise the block material 210 that is formed to a specified dimension prior to delivery to the job site. As yet another example, the composite block 120 may be delivered on-site in fluid and/or granular form and converted to a solid block on-site.

The composite block 120 may be coupled with the spanning support 110 (445) and/or the vertical support 105 using various methods and/or techniques. For example, the composite block 120 may rest on protruding portions of the spanning support 110 and/or the horizontal support 160 and vertical support 105 such that gravity holds the composite block 120 in place above the ground. As another example, the composite block 120 may be coupled to the spanning support 110 and/or the horizontal support 160 with a fastener, an adhesive, a bracket, a binding clip, and/or the like. As yet another example, the dimensions and/or geometry of the composite block 120 may be such that it fits securely within the space between two spanning supports 110 and/or two horizontal support 160 and vertical supports 105.

The buffer material 150 may be installed below the foundation system 100 using various methods and/or techniques. For example, some buffer materials 130 such as foams may be pumped into the void with a hose. As another example, other buffer materials such as cardboard may be installed in a finished configuration. Such material may be implemented prior to installation of spanning supports 110, prior to installation of composite blocks 120, by excavating around the side of the foundation system 100 after installation, and/or the like.

The filler material 140 may be implemented within the foundation system 100 using various methods and/or techniques. For example, the filler material 140 comprised of wire may be implemented within any indentations in the foundation system 100 surface. After installation of the wire, a fluid material such as grout may be poured over the surface and leveled before curing. As another example, the filler material 140 comprised of fluid material may be poured to a portion of the foundation system 100 surface and tended to achieve a specified surface. As yet another example, the filler material 140 comprised of solid material may, be installed in conformance with the surface of the foundation system 100.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises". "comprising". "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A foundation construction method for constructing a foundation on soil, comprising:

installing a plurality of vertical supports in the soil, wherein the vertical supports are adapted to resist movement in response to fluctuation in elevation of the soil;

coupling a first horizontal support between a first vertical support and a second vertical support selected from the plurality of vertical supports;

coupling a second horizontal support between a third vertical support and a fourth vertical support selected from the plurality of vertical supports, wherein the first horizontal support and the second horizontal support define a gap therebetween;

positioning at least one spanning support between the first and second horizontal support, wherein:

a first end of the at least one spanning support is coupled to the first horizontal support;

a second end of the at least one spanning support is coupled to the second horizontal support; and the at least one spanning support comprises:

an upper surface and a lower surface; and a flange extending from the lower surface;

positioning a plurality of composite materials on the flange of the at least one spanning support to fill in the gap between the first and second horizontal supports, wherein the composite materials have a density less than about 0.10 lb/in$^3$ and a maximum compressive strength less than about 2900 psi; and disposing a filler material over and around the plurality of composite materials, wherein the filler material is adapted to:

couple the plurality of composite materials together; and couple the plurality of composite materials to the at least one spanning support.

2. A method according to claim 1, further comprising reinforcing each of the plurality of composite materials with a fibrous material attached to an exterior surface of each of the plurality of composite materials.

3. A method according to claim 2, wherein the fibrous material comprises fiberglass.

4. A method according to claim 1, wherein each of the plurality of vertical supports comprises a helical pier.

5. A method according to claim 1, wherein the first and second horizontal support comprise at least one of a bar joist and an I-beam.

6. A method according to claim 1, wherein the at least one spanning support comprises a bar joist.

7. A method according to claim 1, wherein the block material comprises aerated autoclaved concrete.

8. An apparatus for constructing a foundation adjacent to a soil surface, comprising:

a plurality of vertical supports configured to be disposed a predetermined depth into the soil to resist movement in response to fluctuation in elevation of the soil;

a first horizontal support configured to couple to a first and second vertical support selected from the plurality of vertical supports;

a second horizontal support configured to couple to a third and fourth vertical support selected from the plurality of vertical supports;

a first and second spanning support, each comprising:

a upper and lower flange; and an open web disposed between the upper and lower flange, wherein:

the first spanning support is configured to be coupled between the first and second horizontal supports; and the second spanning support is configured to be coupled between the first and second horizontal supports, wherein the first spanning support and the second spanning support define a gap therebetween;

a plurality of composite blocks disposed between and engaging the lower flange of the first and second spanning supports, wherein each of the plurality of composite blocks has a density less than about 0.10 lb/in$^3$ and a maximum compressive strength less than about 2900 psi; and a filler material disposed over and around the plurality of composite blocks and the open web of the first and second horizontal supports, wherein the filler material is configured to:

couple the plurality of composite blocks together; and couple the plurality of composite blocks to the first and second horizontal supports.

9. An apparatus according to claim 8, further comprising a fibrous reinforcement material coupled to an exterior surface of each of the plurality of composite blocks.

10. A method according to claim 9, wherein the fibrous reinforcement material comprises fiberglass.

11. An apparatus according to claim 8, wherein each of the plurality of vertical supports comprises a helical pier.

12. A method according to claim 8, wherein the first and second horizontal support comprise at least one of a bar joist and an I-beam.

13. A method according to claim 8, wherein each of the first and second spanning support comprises a bar joist.

14. An apparatus according to claim 8, wherein the composite blocks comprise aerated autoclaved concrete.

* * * * *